US008661990B2

(12) United States Patent
Crowe

(10) Patent No.: US 8,661,990 B2
(45) Date of Patent: Mar. 4, 2014

(54) COLLAPSIBLE TRAY FOR FOLD-UP CHAIR

(76) Inventor: Kenneth Reed Crowe, Taylorsville, UT (US)

( * ) Notice: Subject to any disclaimer, the term of this patent is extended or adjusted under 35 U.S.C. 154(b) by 422 days.

(21) Appl. No.: 13/030,060

(22) Filed: Feb. 17, 2011

(65) Prior Publication Data

US 2011/0133523 A1 Jun. 9, 2011

Related U.S. Application Data

(63) Continuation-in-part of application No. 12/470,622, filed on May 22, 2009, now abandoned.

(51) Int. Cl.

| | |
|---|---|
| ***A47B 3/00*** | (2006.01) |
| ***A47F 5/12*** | (2006.01) |
| ***A47B 11/00*** | (2006.01) |
| ***A47B 83/02*** | (2006.01) |

(52) U.S. Cl.
USPC ..... 108/115; 108/6; 108/139; 297/170

(58) Field of Classification Search
USPC ..... 108/6, 115, 139, 163; 211/132.1; 248/460; 297/170
See application file for complete search history.

(56) References Cited

U.S. PATENT DOCUMENTS

| | | | | | |
|---|---|---|---|---|---|
| 601,422 | A * | 3/1898 | Ballow | 108/16 |
| 1,876,983 | A * | 9/1932 | Lidseen | 248/166 |
| 2,396,931 | A * | 3/1946 | Schmid | 5/627 |
| 2,605,155 | A * | 7/1952 | Lewis | 108/139 |
| 3,029,114 | A * | 4/1962 | Oscoz Sanchez | 108/79 |
| 3,379,145 | A * | 4/1968 | Lieberman | 108/166 |
| 3,525,492 | A * | 8/1970 | Kaufman et al. | 248/188.6 |
| 3,656,439 | A * | 4/1972 | Domin | 108/175 |
| 6,240,856 | B1 * | 6/2001 | Paskey et al. | 108/146 |
| 6,260,428 | B1 * | 7/2001 | Clement | 74/89.45 |

* cited by examiner

*Primary Examiner* — Milton Nelson, Jr.
(74) *Attorney, Agent, or Firm* — Jeffrey T. Holman

(57) ABSTRACT

A tray apparatus is described. The tray apparatus includes a collapsible tray. The collapsible tray includes an inner horizontal support. The tray may also include a plurality of outer horizontal supports. The tray also includes a plurality of collapsible extensions. The collapsible extensions are configured to lock into a perpendicular position from the horizontal supports. The tray also includes a plurality of hinged connectors. The hinged connectors connect the inner and outer horizontal supports with the collapsible extensions. Additionally, the apparatus includes a vertical support. The vertical support is connected to the tray assembly by a tray clutch assembly. The tray apparatus may be attached to a chair.

20 Claims, 9 Drawing Sheets

COLLAPSIBLE TRAY FOR FOLD-UP CHAIR

CROSS-REFERENCE TO RELATED APPLICATIONS

This application is a continuation-in-part of U.S. application Ser. No. 12/470,622, filed May 22, 2009, and entitled "Collapsible Tray for Fold-Up Chair," which is incorporated herein in its entirety.

BACKGROUND

When engaged in outdoor activities such as camping, outdoor enthusiasts make use of folding style chairs. While enjoying these types of activities, people will often eat meals, work on a computer, or play games. In doing these activities, people often require a surface on which they can hold a laptop, a plate, or other object in a comfortable and convenient way. Current fold-up chairs frequently provide no surface on which to place items in a convenient manner while sitting.

Additionally, while some chairs have attachments to hold drinks or other objects, many of these attachments are not detachable from these fold-up chairs in a way that allows for portability or storage when these attachments are not in use. Additionally, many of these attachments are bulky and have little flexibility in allowing people of different age and size to use these attachments in a comfortable and convenient way. Many of these attachments make it difficult to get in and out of the chair or adjust the position of the attachment to better suit the person sitting in the chair or the activity being performed by its user.

SUMMARY

Embodiments of an invention described herein relate to a collapsible tray for a fold-up chair.

Embodiments of a collapsible tray for a fold-up chair are described. In one embodiment, the apparatus is a collapsible tray. The collapsible tray has a plurality of horizontal supports. The tray also has at least one collapsible extension. The collapsible extensions are configured to lock in a perpendicular position from the horizontal supports. The apparatus also has a plurality of hinge connectors. The hinge connectors connect the horizontal supports with the collapsible extensions.

In another embodiment, a tray assembly is described. The tray assembly includes a collapsible tray. The collapsible tray includes an inner horizontal support. The tray also includes at least one outer horizontal support. The tray also includes a plurality of collapsible extensions. The collapsible extensions are configured to lock into a perpendicular position from the horizontal supports. The tray also includes a plurality of hinged connectors. The hinged connectors connect the inner and outer horizontal supports with the collapsible extensions. Additionally, the apparatus includes a vertical support. The vertical support is connected to the tray assembly by a tray clutch assembly.

In another embodiment, a tray apparatus is described. The tray apparatus includes a collapsible tray. The tray includes an inner horizontal support. The tray also includes at least one outer horizontal support. The tray also includes a plurality of collapsible extensions connecting the inner and outer horizontal supports to a plurality of connection points. The collapsible extensions are configured to pivot around the connection points, collapsing the inner and outer horizontal supports into a collapsed position. Additionally, the tray apparatus includes a chair attached to the collapsible tray.

BRIEF DESCRIPTION OF THE DRAWINGS

Throughout the description, similar reference numbers may be used to identify similar elements.

DETAILED DESCRIPTION

Figure 1:
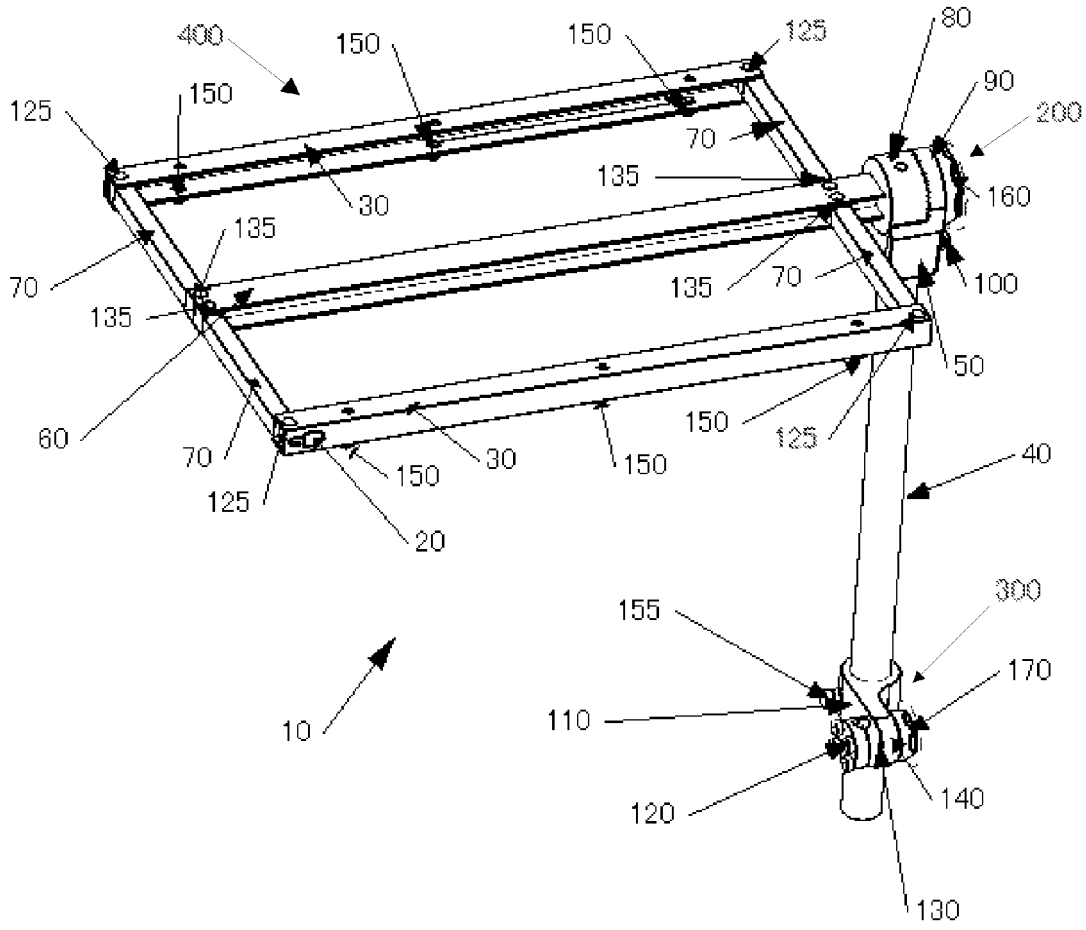
FIG. 1 depicts a schematic diagram of a tray assembly.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some of the described embodiments include a collapsible tray. In this description, references to a tray may refer to any object or objects with a flat surface. Moreover, although embodiments are described herein as a tray assembly for attaching to an outdoor chair, the apparatus more generally may be used as an attachment to a chair, a table, or any other fixture capable of attaching to a portable surface area, regardless of whether it is a chair or not.

FIG. 1 shows a schematic diagram of an embodiment of a collapsible tray assembly 10. In the illustrated embodiment, the assembly 10 includes a collapsible tray 400. The illustrated tray 400 includes an inner horizontal support 60 extending horizontally across the tray 400. The tray 400 may also include one or more outer horizontal supports 30 extending horizontally and parallel to the inner horizontal support 60 when the tray 400 is in an open position. These outer horizontal supports 30 and the inner horizontal support 60 may be connected by one or more collapsible extensions 70 connecting the ends of the inner and outer horizontal supports 60, 30. When in an open position, these collapsible extensions 70 extend between the inner and outer horizontal supports 60, 30 in a perpendicular direction. While the illustrated embodiment shows four collapsible extensions 70 located at the ends of the inner and outer horizontal supports 60, 30, they may also be located at any point, and in any number along the body of the horizontal supports 60, 30, providing additional points of connection or structure to the collapsible tray 400.

FIG. 1 also illustrates a plurality of outer connectors 125. The outer connectors 125 connect the outer horizontal supports 30 and the collapsible extensions 70. Additionally, the outer connectors 125 provide a pivot point around which the outer supports 30 and collapsible extensions 70 may rotate into an open or collapsed position. The illustrated embodiment also includes a plurality of inner connectors 135. The inner connectors 135 connect the inner horizontal support 60 and the collapsible extensions 70. Like the outer connectors 125, the inner connectors 135 also provide a pivot point around which the collapsible extensions and inner horizontal support 60 may rotate, allowing the connectors 125, 135 and the collapsible extensions 70 to pivot into an open or collapsed position. Additionally, the tray 400 and the inner and outer supports 60, 30 may be held in an open position by a tray extension lock 20. The tray extension lock 20 may be located on the outer horizontal supports 30. When the tray extension lock 20 is in a locked position, the outer and inner connectors 125, 135 stay in a locked position, without allowing the inner and outer horizontal supports 60, 30 to pivot in and out of the locked position. A user may unlock the frame of the tray 400 by depressing the tray extension lock 20, and pivoting the outer supports 30 and collapsible extensions into a collapsed position, as shown in the illustrated embodiment.

FIG. 1 also illustrates a vertical support 40 attached to the collapsible tray 400 by a tray clutch assembly 200. The tray clutch assembly 200 is connected to the vertical support 40 by a tray mount 50. The tray clutch assembly 200 may be configured to allow the collapsible tray 400 to tilt or rotate on an axis around the inner horizontal support 60 as well as rotate horizontally around the vertical support 40. In the illustrated embodiment, the inner horizontal support 60 of the collapsible tray 400 is attached to the tray clutch assembly 200 at an inner clutch plate 80 which is connected to a tray mount 50. The tray mount 50 may be attached or detached from the vertical support 40, allowing for the collapsible tray 400 and the tray clutch assembly 200 to be attached or detached from the vertical support 40. This attachable and removable feature allows for increased portability and storage capability of the tray assembly 10 as well as interchangeability between different chairs or other structures.

FIG. 1 also illustrates a leg attachment 300 attached to the vertical support 40. The leg attachment 300 may attach to a leg or arm of a chair or other object. The leg attachment 300 is also configured to slide up and down the vertical support 40 for adjusting the vertical position of the collapsible tray 400 to a desired height.

Figure 2:
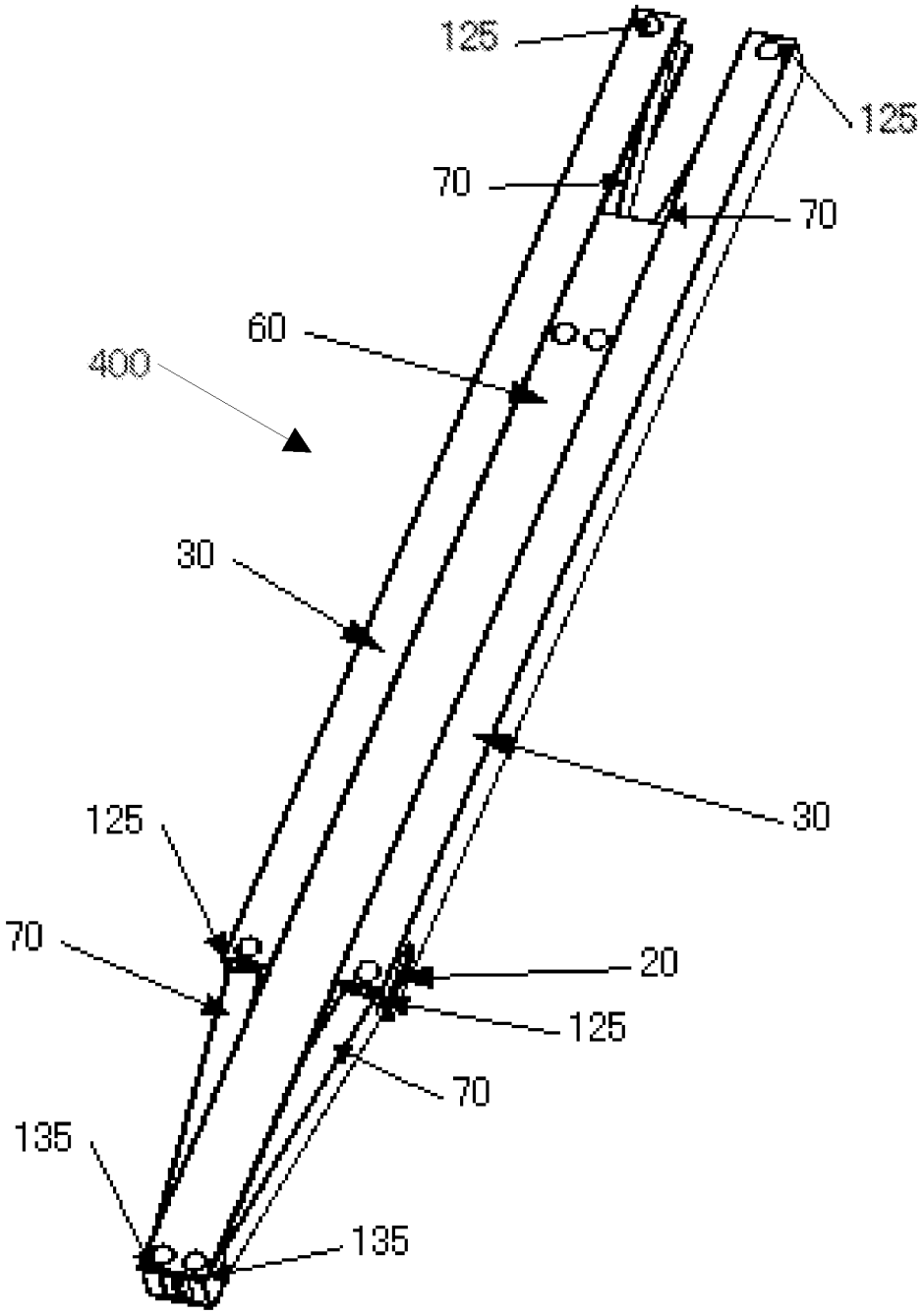
FIG. 2 depicts a schematic diagram of a tray in a collapsed position.

FIG. 2 shows a schematic diagram of one embodiment of a collapsible tray 400 in a collapsed position. The illustrated tray 400 includes an inner horizontal support 60 and a plurality of outer horizontal supports 30. The tray 400 also includes a plurality of collapsible extensions 70 connected to the outer horizontal supports 30 and the inner horizontal support 60. While the collapsible extensions 70 extend in a perpendicular direction from the inner and outer horizontal supports 60, 30 in the open and locked configuration, when the tray 400 is in a collapsed position, the collapsible extensions collapse to align in a parallel or near-parallel position to the inner and outer horizontal supports 60, 30. The illustrated embodiment also includes a plurality of inner and outer connectors 135, 125. The outer connectors 125 connect the outer horizontal supports 30 with the collapsible extensions 70. The inner connectors connect the inner horizontal support 60 with the collapsible extensions 70. The illustrated tray also includes a tray extension lock 20. When in a collapsed position, the tray extension lock 20 is depressed, thereby allowing the inner and outer connectors 135, 125 to pivot, allowing the horizontal supports 60, 30 and the collapsible extensions 70 to collapse. Furthermore, the tray 400 may be detached from the vertical support 40 for convenience, storage, attaching to another fixture, or other purposes.

Figure 3:
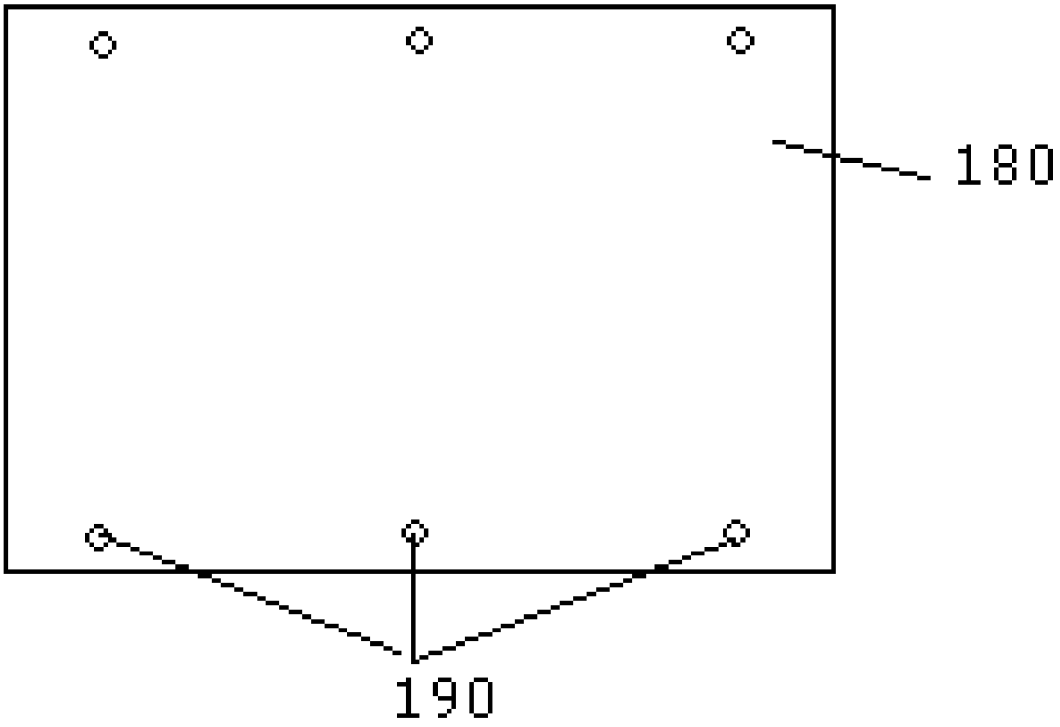
FIG. 3 depicts a schematic diagram of a tray cover.

FIG. 3 shows a simple schematic of one embodiment of a cover 180. The cover 180 may attach to outer horizontal supports 30 of a collapsible tray 400. When attached to the tray 400 the cover 180 provides a weather-proof surface to the tray, protecting the tray itself from exposure as well as providing a surface for a user to perform different activities, such as eating, using a computer, playing games, placing objects, or other activities that require a surface. The cover 180 may be made from a variety of weather-proof or durable materials, such as acrylic, polyester, nylon, or other material. The cover 180 may attach to the horizontal supports by a plurality of connectors 190. The connectors 190 may attach to the horizontal supports at connection points 150. The connectors 190 may be buttons, clips, grommets, magnets, or any other device providing connection points 150 between a cover 180 and a tray 400.

Figure 4:
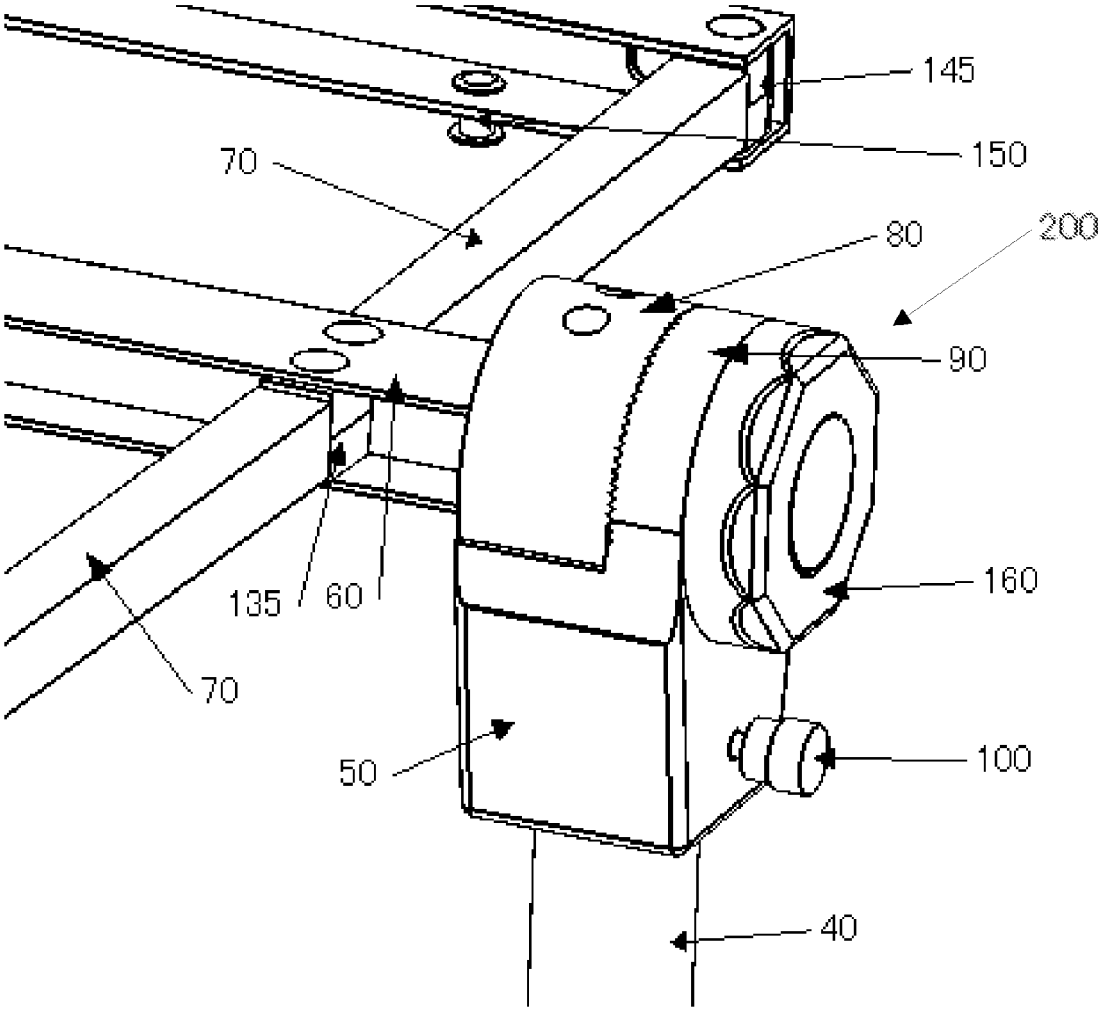
FIG. 4 depicts a schematic diagram of a tray clutch assembly.

FIG. 4 shows a schematic diagram of a tray clutch assembly 200. In the illustrated embodiment, the tray clutch assembly 200 is attached to the inner horizontal support 60 of the collapsible tray 400. In other embodiments, the tray clutch assembly 200 may be attached to the tray at any of the horizontal supports. The tray clutch assembly 200 is attached to the collapsible tray 400 by a movable inner clutch plate 80. The inner clutch plate 80 is mated to a stationary outer clutch plate 90 by sliding a threaded collar of the inner clutch plate 80 through the outer clutch plate 90 and locking the clutch plates 80, 90 together by tightening a tray clutch adjustment nut 160. In the illustrated embodiment, both the inner and outer clutch plates 80, 90 are toothed and locked together by tightening the tray clutch adjustment nut 160. The collapsible tray 400 may also be rotated around an axis extending perpendicular to a vertical support 40 with the tray clutch assembly 200 as the pivoting point. In the illustrated embodiment, the axis extending perpendicular to the vertical support 40 runs along the inner horizontal support 60, but may extend around any or none of the inner or outer horizontal supports 60, 30. The tilt of the tray 400, or rotation of the tray 400 around the axis extending perpendicular from the vertical support, may be adjusted by loosening the clutch adjustment nut 160 and tilting the tray 400. The tilt of the tray 400 may then be locked at a specific angle by re-tightening the clutch adjustment nut 160.

FIG. 4 also illustrates the connection of the tray clutch assembly 200 to the vertical support 40. In the illustrated embodiment, the frame of the tray clutch assembly 200 is attached to the vertical support 40 by a tray mount 50. The tray mount 50 may be attached or detached from the vertical support 40. The tray mount may be locked or unlocked in an attached position by a mount pivot lock 100 attached to the outside of the tray mount 50. When the mount pivot lock 100 is in an unlocked position, the tray mount 50 may be attached or detached from the vertical support 40. Additionally, when the mount pivot lock 100 is in an unlocked position, the tray clutch assembly 200 may be rotated around the vertical support 40, also making the tray 400 rotate around the vertical axis of the vertical support 40.

Figure 5:
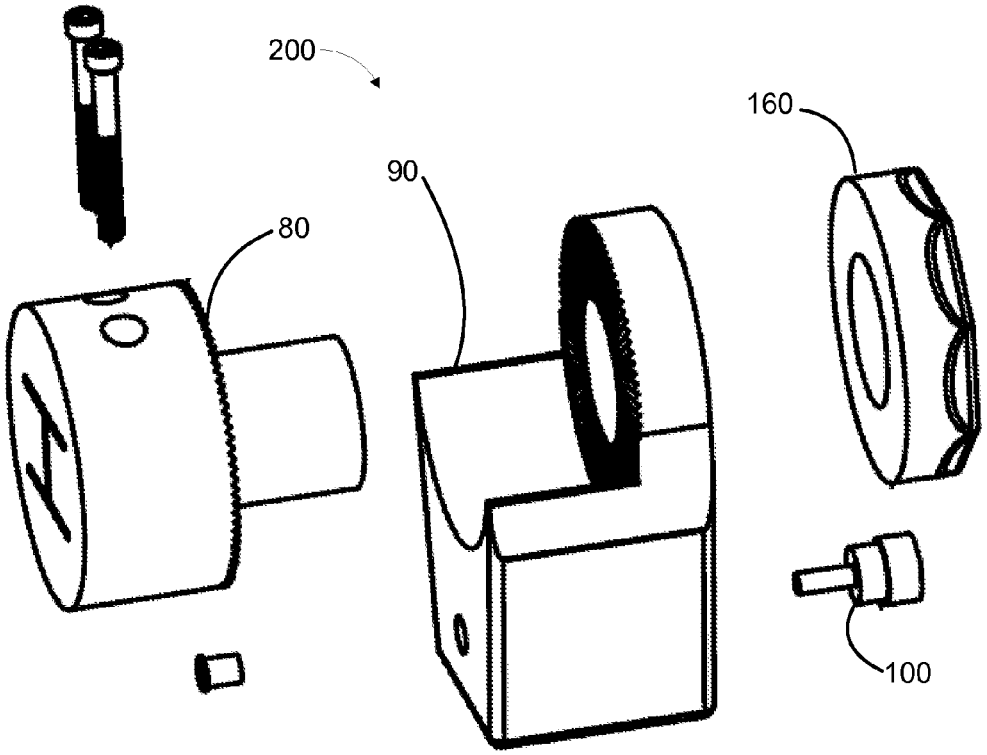
FIG. 5 depicts an exploded view of a tray clutch assembly.

FIG. 5 illustrates an exploded view of the tray clutch assembly 200. The tray clutch assembly may attach to a tray 400 by an inner clutch plate 80. The illustrated embodiment shows the connection of the inner clutch plate 80 with the outer clutch plate 90 by sliding a threaded collar of the inner clutch plate 80 through the outer clutch plate 90 and locking the clutch plates 80, 90 together with a clutch adjustment nut 160. The illustrated embodiment further shows the attachment of the mount pivot lock 100 and how it attaches to the tray mount 50. Also, the illustrated embodiment shows the connection of the inner clutch plate 80 to a tray 400 by insertion of screws or pins into holes on the side of the inner clutch plate 80.

Figure 6:
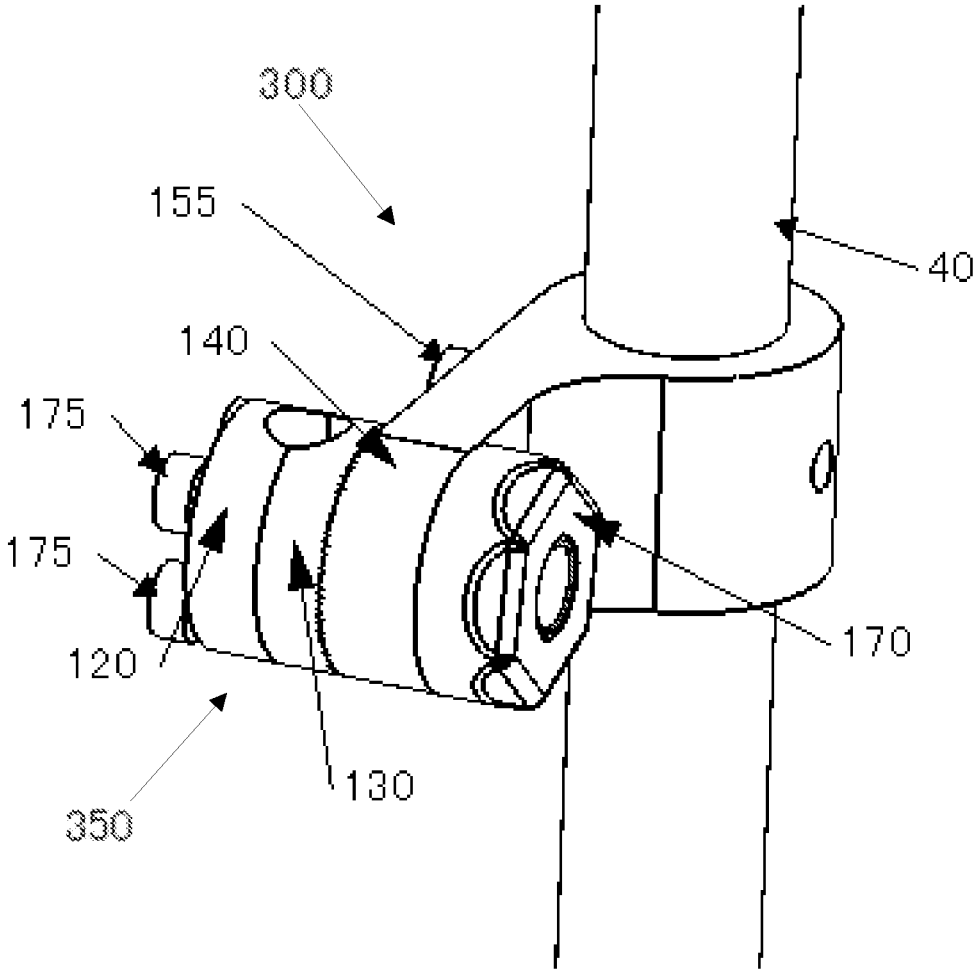
FIG. 6 depicts a schematic diagram of a leg attachment.

FIG. 6 shows a schematic diagram of one embodiment of a leg attachment 300 for attaching the tray assembly 10 to a chair, table, or other object. In the illustrated embodiment, the leg attachment 300 includes a chair mount 140 attached to a vertical support 40. The chair mount 140 may slide vertically along the vertical support 40, thereby adjusting position of a collapsible tray 400. The chair mount is fastened to the vertical support 40 by a vertical lock screw 155. When the vertical lock screw 155 is in a loosened or unlocked position, the chair mount 140 may slide vertically along the vertical support 40. When the vertical lock screw 155 is tightened or locked, the chair mount 140 is locked in a fixed position relative to the vertical support 40. The vertical lock screw 155 may be a screw, a pin, a nut, a knob, or any device capable of tightening or loosening the chair mount 140 from a vertical support 40.

FIG. 6 also illustrates an attachment assembly 350 between the chair attachment 300 and a chair, table, or other fixed object. In the illustrated embodiment, the attachment assembly 350 includes a mounting plate 120, a movable chair mount clutch plate 130, one or more attachment screws 175, and a clutch adjustment nut 170. The attachment assembly 350 attaches to the fixed object by clamping a chair attachment plate 120 and a movable chair mount clutch plate 130 to the fixed object using one or more attachment screws 175. The attachment screws 175 are threaded into inserts inside the clutch plate 130 and holds the mounting plate 120 and clutch plate 130 securely to the fixed object. The chair mount 140 is mated to the movable clutch 140 by tightening the clutch adjustment nut 170. In the illustrated embodiment, the angle between the vertical support 40 and the attachment assembly 350 may be adjusted by loosening the clutch adjustment nut 170 and rotating the attachment assembly 350 around an axis running through the attachment assembly, perpendicular to the vertical support 40, to a desired position and angle. The attachment assembly 350 may then be fixed at a relative angle to the vertical support 40 by tightening the attachment assembly 350 into a fixed position relative to the vertical support 40. This rotational feature, coupled with the rotational features of the tray clutch assembly 200, allows for the tray assembly 10 to be used for a variety of users of different sizes, as well as for multiple applications.

Figure 7:
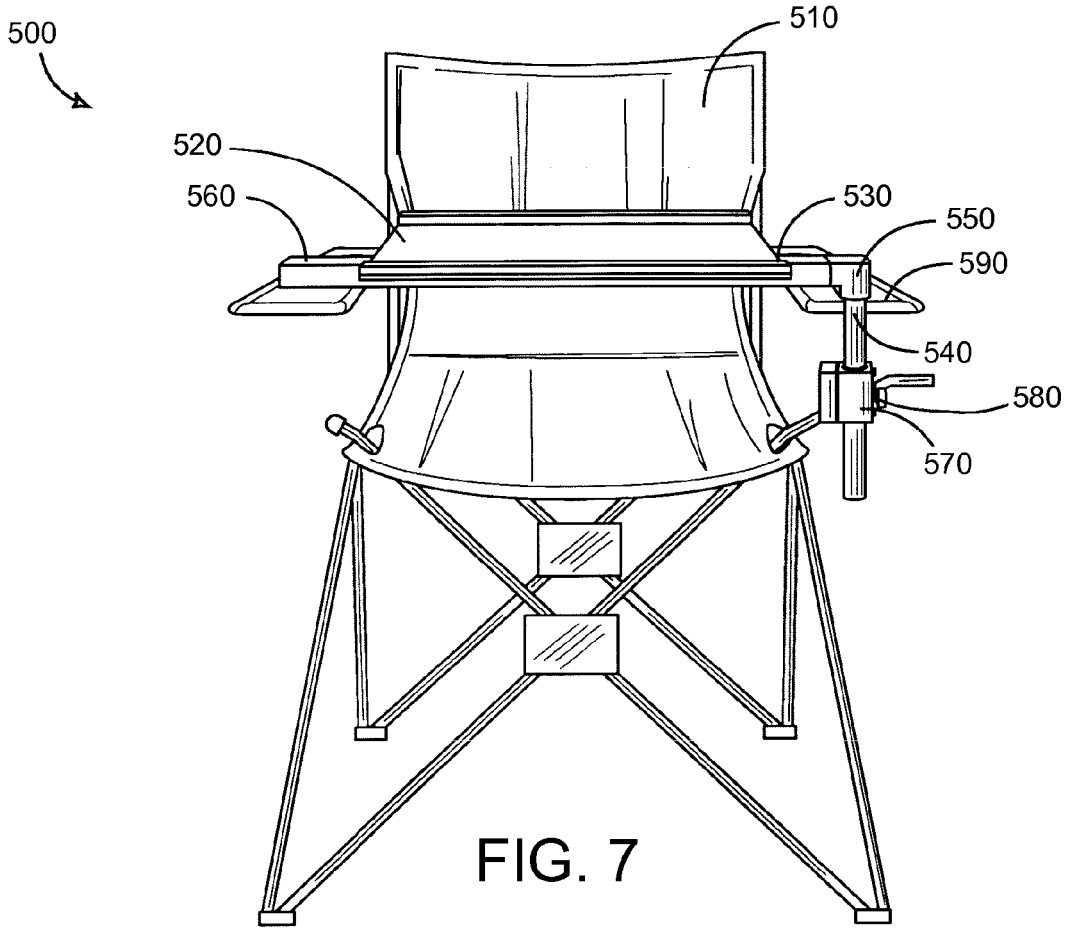
FIG. 7 depicts a schematic diagram of a collapsible tray assembly attached to a chair.

FIG. 7 shows a diagram of an apparatus 500 including with an attached collapsible tray. The attached tray assembly 10 may include similar or identical features as the collapsible tray assembly 10 described above. In the illustrated embodiment, the tray attachment includes an inner horizontal tray support 560 and a plurality of outer tray supports 530. The outer tray supports 560 are attached to a flexible tray surface 520 made of a durable and/or weather-proof material. The tray surface 520 may be made from a variety of weather-proof or durable materials, such as acrylic, polyester, nylon, or other material. In the illustrated embodiment, the horizontal support 560 is attached to a frame connector 550. The side of the horizontal support 560 may optionally rest on an arm 590 of the chair 510 to provide additional support. The frame connector 550 is connected to a vertical frame support 540 around which the tray is capable of rotating. In the illustrated embodiment, the vertical frame connector 540 is connected to a tray mount 570, the tray mount 570 being connected to a leg of the chair 510 with screws or locks 580.

Figure 8:
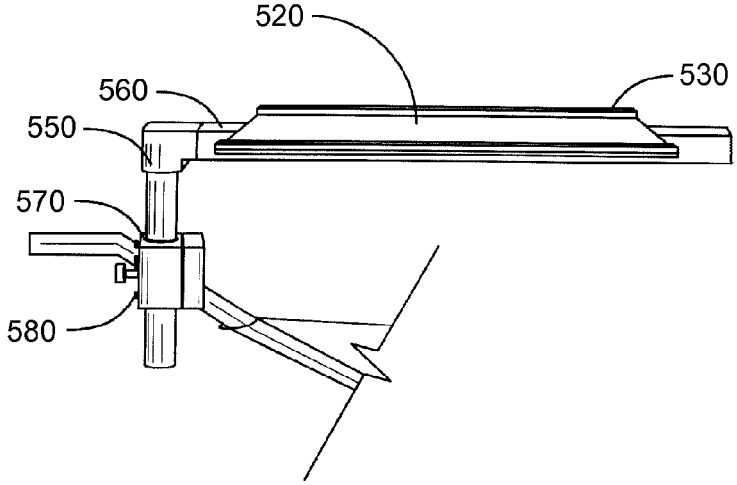
FIG. 8 depicts a schematic diagram of a tray assembly.

FIG. 8 shows an isolated view of the attached tray assembly of FIG. 6. As discussed previously, the tray may attach or detach from a variety of chairs, tables, or other objects. The frame of the tray attachment, including the vertical support and other attachment points may be made from a variety of durable materials, including aluminum, plastic, steel, or other materials capable of withstanding weight place on the tray and outdoor weather conditions.

Figure 9:
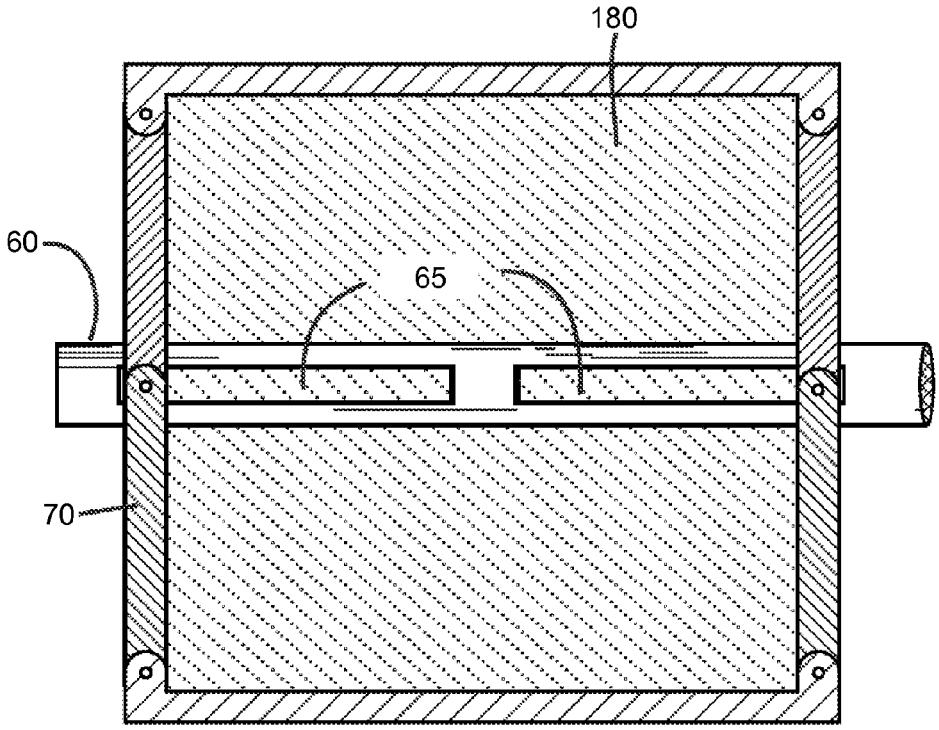
FIG. 9 depicts a schematic diagram of a collapsible tray in an open position.

FIG. 9 shows another embodiment of the collapsible tray 400. In the illustrated embodiment, the collapsible tray includes a cover 180 and a horizontal support 60 attached to collapsible extensions 70. The horizontal support 60 may also include a slot, groove or equivalent sliding mechanism 65 in the body of the horizontal support 60. A plurality of pivoting and sliding bolts, screws or other equivalent connection devices 135 may then slide along the slot 65 of the horizontal support 60 collapsing the tray 400 into a compact state.

Figure 10:
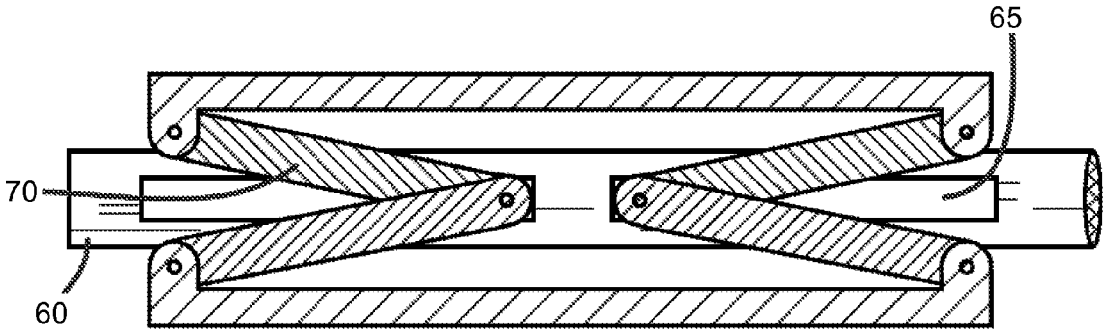
FIG. 10 depicts a schematic diagram of a tray in a collapsed position.

FIG. 10 shows the collapsible tray of FIG. 9 in a collapsed state. In the collapsed state, the outer horizontal supports 30 are able to collapse and come into contact with the inner horizontal support 60 in a parallel orientation to the other horizontal supports 60, 30. Also in the illustrated embodiment, the collapsible extensions 70 collapse inward from the outsides of the tray 400, rather than collapsing in the same direction as the other collapsible extensions 70. This allows for the tray 400 to be collapsed in a more compact way, thereby enhancing storage capabilities and portability of the device.

Figure 11:
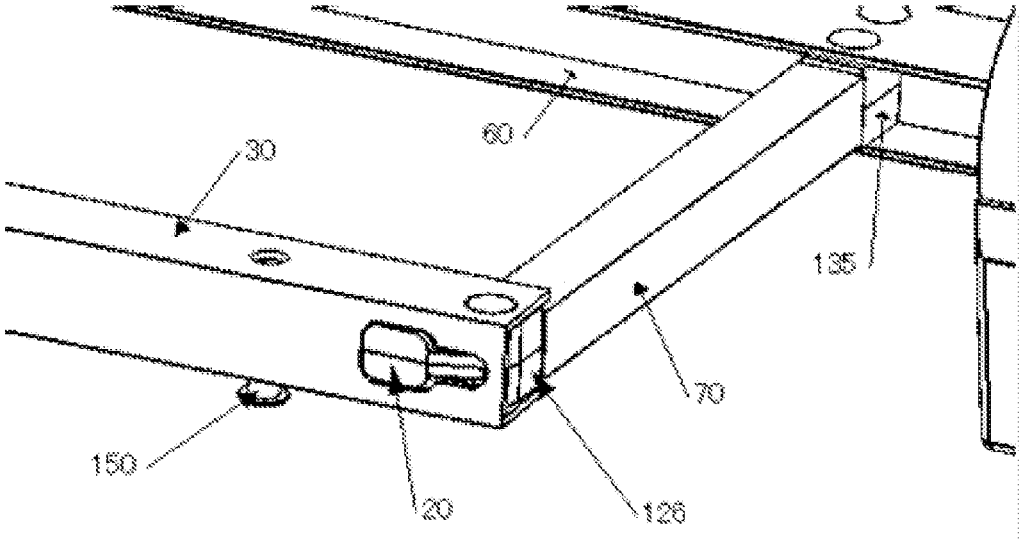
FIG. 11 depicts a schematic diagram of a tray extension lock in locked position.

FIG. 11 shows an enlarged portion of the collapsible tray 400. The illustrated embodiment shows the connection of an outer support 30 and a collapsible extension 70 in a locked position. In the illustrated embodiment, the outer support 30 and collapsible extension 70 are connected at an outer connection 125 and locked into position by a tray extension lock 20. When the tray 400 is extended into an open position, the tray extension lock 20 locks into place, and the tray 400 remains in an open position. The tray extension lock 20 may be unlocked by pushing onto a tab 126 through a cut-out 127 in the outer support 30 and rotating the outer support 30 and the collapsible extension 70 into a collapsed position. While the illustrated embodiment only shows one tray extension lock 20, the collapsible tray 400 may include several tray extension locks 20 at various connection points 125, allowing multiple outer horizontal supports 30 to collapse into a collapsed position.

Figure 12:
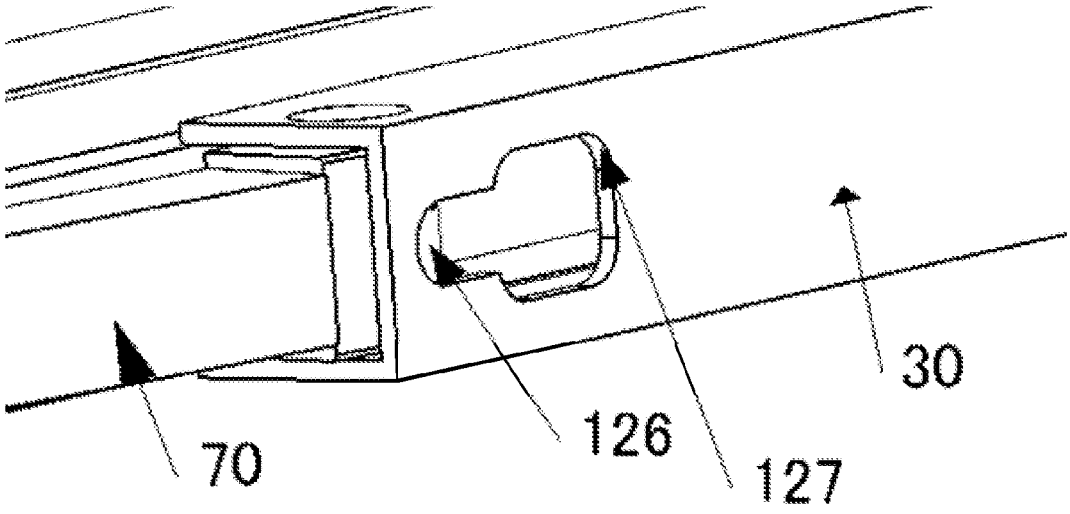
FIG. 12 depicts a schematic diagram of a tray extension lock in an open position.

FIG. 12 shows an enlarged portion of the tray extension lock 20 in an unlocked position. As illustrated, the tray extension lock 20 includes a tab 126 and a cut-out 127 in the outer horizontal support 30. When the collapsible tray 400 is extended into an open position, the tab 126 aligns with the corresponding cut-out 127 and snaps into a fixed position, with at least one side of the tab 126 abutting the side of the cut-out 127. When in a locked position, the outer support 30 and collapsible extension 70 are locked at a fixed angle in relation to each other, and the collapsible tray 400 is held in an open position. The tray extension lock 20 may be released by depressing the tab 126 through the cut-out 127 so that a side of the tab 126 slides under the side of the cut-out 127, allowing the outer horizontal support 30 and the collapsible extensions 70 to pivot into a collapsed position.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A collapsible tray apparatus comprising:

a plurality of horizontal supports, wherein at least one of the plurality of horizontal supports comprises a cantilever support point to support at least a portion of the tray apparatus in a substantially horizontal orientation;

at least one collapsible extension, the at least one collapsible extension configured to lock into a perpendicular position from the plurality of horizontal supports; and a plurality of hinged connectors, wherein the plurality of hinged connectors connect the plurality of horizontal supports with the at least one collapsible extension.

2. The collapsible tray apparatus of claim 1, further comprising a tray extension lock, the tray extension lock configured to lock the collapsible tray apparatus into an open position and release the collapsible tray apparatus into a closed position.

3. The collapsible tray apparatus of claim 1, further comprising a tray cover, the tray cover configured to attach to at least one of the plurality of horizontal supports.

4. The collapsible tray apparatus of claim 3, wherein the tray cover comprises a plurality of connectors on the plurality of horizontal supports to fasten the cover to the collapsible tray apparatus.

5. An tray assembly comprising:

a collapsible tray, the collapsible tray comprising:

an inner horizontal support;

at least one outer horizontal support;

a plurality of collapsible extensions, the plurality of collapsible extensions configured to lock into a perpendicular position from the horizontal supports; and a plurality of hinged connectors, wherein the plurality of hinged connectors connect the inner and outer horizontal supports with the collapsible extensions; and a vertical support, the vertical support being connected to the collapsible tray by a tray clutch assembly.

6. The tray assembly of claim 5, wherein the collapsible tray further comprises a tray extension lock, the tray extension lock configured to lock the collapsible tray into an open position and release the collapsible tray into a closed position.

7. The tray assembly of claim 5, wherein the tray clutch assembly is connected to one of the horizontal supports and is detachable from the vertical support.

8. The tray assembly of claim 5, wherein the tray clutch assembly is configured to rotate horizontally around the vertical support, adjusting the horizontal position of the collapsible tray.

9. The tray assembly of claim 8, wherein the tray clutch assembly comprises a mount pivot lock, wherein the tray clutch assembly is configured to rotate when the mount pivot lock is in an unlocked position and wherein the tray clutch assembly locks into a fixed horizontal position when the mount pivot lock is in a locked position.

10. The tray assembly of claim 5, wherein the tray clutch assembly is configured to rotate the collapsible tray around an axis running perpendicular to the vertical support.

11. The tray assembly of claim 10, wherein the tray clutch assembly comprises a clutch adjustment nut, wherein loosening the clutch adjustment nut allows the collapsible tray to rotate around the axis running perpendicular to the vertical support and tightening the clutch adjustment nut locks the collapsible tray into a fixed position around the axis running perpendicular to the vertical support.

12. The tray assembly of claim 5, further comprising a tray cover, the tray cover configured to attach to the at least one outer horizontal support.

13. The tray assembly of claim 12, wherein the tray cover comprises a plurality of connectors configured to attach the tray cover to the at least one outer horizontal support at a plurality of connection points.

14. The tray assembly of claim 5, further comprising a leg attachment, wherein the leg attachment is configured to attach to an arm or leg of a chair.

15. The tray assembly of claim 14, wherein the leg attachment slides vertically along the vertical support, adjusting the vertical position of the collapsible tray.

16. The tray assembly of claim 15, wherein the leg attachment comprises a vertical lock screw, wherein loosening the vertical lock screw allows the leg attachment to slide vertically with respect to the vertical support and tightening the vertical lock screw locks the leg attachment into a fixed position with respect to the vertical support.

17. The tray assembly of claim 14, wherein the leg attachment comprises an attachment assembly, wherein the attachment assembly rotates around an axis running perpendicular to the vertical support.

18. The tray assembly of claim 17, wherein the attachment assembly comprises a clutch adjustment nut, and wherein the attachment assembly is configured to rotate around an axis running perpendicular to the vertical support when the clutch adjustment nut is loosened, and wherein the attachment assembly is configured to lock into a fixed rotational position when the clutch adjustment nut is tightened.

19. A tray system comprising:

a plurality of horizontally-oriented supports;

a flexible tray surface, wherein the plurality of horizontally-oriented supports are configured to secure the flexible tray surface to the plurality of horizontally-oriented supports in a taut configuration;

at least one collapsible extension configured to lock into a perpendicular position relative to the plurality of horizontally-oriented supports; and a plurality of hinged connectors to connect the plurality of horizontally-oriented supports with the at least one collapsible extension.

20. The system of claim 19, further comprising a tray extension lock configured to lock the at least one collapsible tray extension into an open position and to release the at least one collapsible tray extension into a closed position.

* * * * *